US006267552B1

(12) United States Patent
Weigand

(10) Patent No.: US 6,267,552 B1
(45) Date of Patent: Jul. 31, 2001

(54) ARRANGEMENT OF HOLES FOR FORMING A COOLING FILM

(75) Inventor: Bernhard Weigand, Lauchringen (DE)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/312,061

(22) Filed: May 17, 1999

(30) Foreign Application Priority Data

May 20, 1998 (EP) ..... 98810475

(51) Int. Cl.[7] ..... F01D 5/18
(52) U.S. Cl. ..... 415/115; 416/97 R
(58) Field of Search ..... 415/115; 416/95, 416/96 A, 97 A, 96 R, 97 R; 60/754, 755, 757, 265

(56) References Cited

U.S. PATENT DOCUMENTS

| | | | | |
|---|---|---|---|---|
| 4,676,719 | | 6/1987 | Auxier et al. . | |
| 4,726,735 | * | 2/1988 | Field et al. | 416/97 R |
| 5,096,379 | | 3/1992 | Stroud et al. . | |
| 5,374,162 | | 12/1994 | Green . | |
| 5,577,889 | * | 11/1996 | Terazaki et al. | 416/97 R |
| 5,586,859 | * | 12/1996 | Nolcheff | 415/58.5 |
| 5,816,777 | * | 10/1998 | Hall | 416/97 R |

FOREIGN PATENT DOCUMENTS

| | | |
|---|---|---|
| 3508976A1 | 5/1996 | (DE) . |
| 0501813A1 | 9/1992 | (EP) . |
| 0501813B1 | 9/1992 | (EP) . |

OTHER PUBLICATIONS

"Adiabatic Wall Temperature and Heat Transfer Downstream of Injection Through Two Rows of Holes", Jabbari, et al., Journal of Engineering for Power, Apr. 1978, pp. 303–307.

* cited by examiner

*Primary Examiner*—Edward K. Look
*Assistant Examiner*—Richard Woo
(74) *Attorney, Agent, or Firm*—Burns, Doane, Swecker & Mathis, L.L.P.

(57) ABSTRACT

Arrangement of holes for forming a cooling film on a wall (50) which is subjected to a flow of hot gas. Two rows (1, 2) of holes (10, 20) are provided which are arranged adjacent to one another, the diameter (d1) of the upstream holes (10) being smaller than the diameter (d2) of the upstream holes (20). The number of upstream holes (10) is equal to or smaller than the number of downstream holes (20). The use of such an arrangement of holes achieves the formation of an extremely effective cooling film with a simultaneously small consumption of cooling air.

10 Claims, 7 Drawing Sheets

ARRANGEMENT OF HOLES FOR FORMING A COOLING FILM

BACKGROUND OF THE INVENTION

1. Field of the Invention

The invention relates to an arrangement of holes for forming a cooling film on a component wall subjected to a flow of hot gas, the component being in particular a turbine vane or blade or a combustion chamber of a gas turbine, 2. Discussion of Background The publication "Journal of Engineering for Power", April 1978, Vol. 100, Pages 303 to 307, reveals a test set-up for the simulation of a cooling film, in which a flat plate is provided with holes which represent the ejection openings of tubes set at an angle of 35° relative to the plane of the plate. The holes are arranged in the form of two rows which are staggered and laterally offset relative to the main flow direction.

The series of tests described in this article indicate a marked increase in the cooling effect relative to an individual row of holes. This effect is attributed to the fact that the jets of cooling air emerging from the first row deflect the cooling air jets emerging from the second row onto the surface of the wall to be cooled and, by this means, increase their cooling effectiveness. In addition, the cooling film of the first row of holes forming further downstream is located above the cooling film of the row of second holes and additionally protects the latter from the penetration of hot gas.

DE 35 08 976 A1 shows a turbine vane or blade which, because of the high level of thermal loading, is provided with a plurality of rows of holes in order to form cooling films. In the stagnation point region and adjacent to it on the suction surface, three adjacently located rows of holes are provided in each case in order to further increase the cooling effect in these particularly highly thermally loaded wall portions of the turbine vane or blade. In this arrangement, it is accepted that the cooling air requirement is increased because of the many rows of holes.

A similar direction is indicated by the turbine vane or blade known from EP 0 501 813 B1 in which various variants of hole arrangements in a double row are proposed for the formation of a cooling film. One of the variants proposes allocating two holes of small diameter in the first row to each hole of larger diameter in the second row. The association of the holes in the first row with the respective holes in the second row follows from the fact that these are configured as flow branches of a common inlet opening.

Disadvantageous in this solution is again the high consumption of cooling air, which is caused by the large number of outlet openings in the first row. A further disadvantage may be considered as being the low flexibility in the selection of the direction of the individual holes because the latter start from a single, common inlet hole. In particular, the cooling air jets emerging from the holes in the first row have directional components extending in different directions which point laterally, i.e. at right angles to the main flow, which is undesirable in many cases.

SUMMARY OF THE INVENTION

The invention attempts to avoid the disadvantages described. Accordingly, one object of the invention is to provide a novel arrangement of holes, of the type described at the beginning, which makes it possible to form a cooling film of high efficiency with a reduced cooling air requirement.

In accordance with the invention, this is achieved in an arrangement of holes, by the number of holes in the first row being substantially equal to or smaller than the number of holes in the second row.

In contrast to the previously usual tendency to improve the effectiveness of the cooling film by providing a further row of holes or by increasing the number of outlet openings in the first row, the opposite path is followed in the present case. It has, surprisingly, been found that the effectiveness of the cooling performance can be increased if a hole of smaller diameter in the first row is associated with each hole of the second row. This therefore results in substantially equal numbers of holes in the first and second rows.

With respect to the effectiveness of the cooling performance, it has been found particularly effective for the outlet openings of the holes in the second row to be arranged, relative to the direction of the flow of hot gas, offset to the side of the outlet openings of the holes in the first row. It is considered optimum that the outlet openings of the holes in the second row should be provided downstream in the center between the outlet openings of the holes in the first row.

Particularly effective superpositioning of the partial film formed by the holes in the first row on that of the second row results when, in accordance with a preferred variant, the holes in the first row are aligned with their axes substantially parallel to the holes in the second row.

Tests have shown that the cooling effect is an optimum when the diameter of the hole of the first row is greater than or equal to half the diameter of the holes in the second row. The last-mentioned condition, in particular, offers an optimum compromise between an outstanding effectiveness of the cooling performance, on the one hand, and a minimal requirement for cooling air, on the other.

In this connection, the selection of the distance between the two rows is also of particular importance. Values for the distance have been found to be optimum which are smaller than or equal to five times the arithmetic average of the diameter of the holes of the first and second rows, i.e. which satisfy the following equation:

$$p \leqq 5(d_1+d_2)/2,$$

where p is the distance between the two rows, $d_1$ is the diameter of the holes in the first row and $d_2$ is the diameter of the holes in the second row.

A further improvement in the cooling effectiveness can then be achieved if the holes in the second row, at least, have an axial portion with a funnel-shaped variation of cross-section in the region of the outlet openings. The increase in the cross section in the outlet plane achieved by this leads to a reduction in the outlet velocity of the partial cooling flows. It can then be advantageous for the axis of rotation of the funnel-shaped axial portion not to extend coaxially with respect to the axis of rotation of the rest of the hole but to be inclined somewhat in the direction of the main flow. This brings the emerging cooling air jet substantially closer to the surface to be cooled.

Although the reason for the positive properties of outlet openings which widen in the shape of a funnel are known, this feature is much more expensive than cylindrical bores. The reason is that the outlet openings have to be shaped with a high level of precision because, otherwise, the emerging cooling air flows do not form a well attached cooling film. This demands an expensive manufacturing process (EDM process).

This problem does not arise in the case of the arrangement of holes in accordance with the invention. In this arrangement, funnel-shaped outlet openings formed by means of laser have the same cooling efficiency as those outlet openings which have been manufactured with high precision with the previously employed spark erosion process because the jet from the first cooling hole presses the cooling air jet from the funnel-shaped hole onto the wall. This makes it possible to employ the relatively low-cost laser method for forming funnel-shaped outlet openings.

A further increase in the cooling performance can be achieved if, in an especially preferred variant, the holes in the first row also have an axial portion with funnel-shaped variation of cross-section in the region of the outlet openings. In this case, it is additionally necessary to meet the condition that the area of each of the outlet openings in the first row is smaller than the area of each of the outlet openings in the second row.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only components essential for understanding the invention are shown.

DESCRIPTION OF THE PREFERRED EMBODIMENTS

Figure 1:
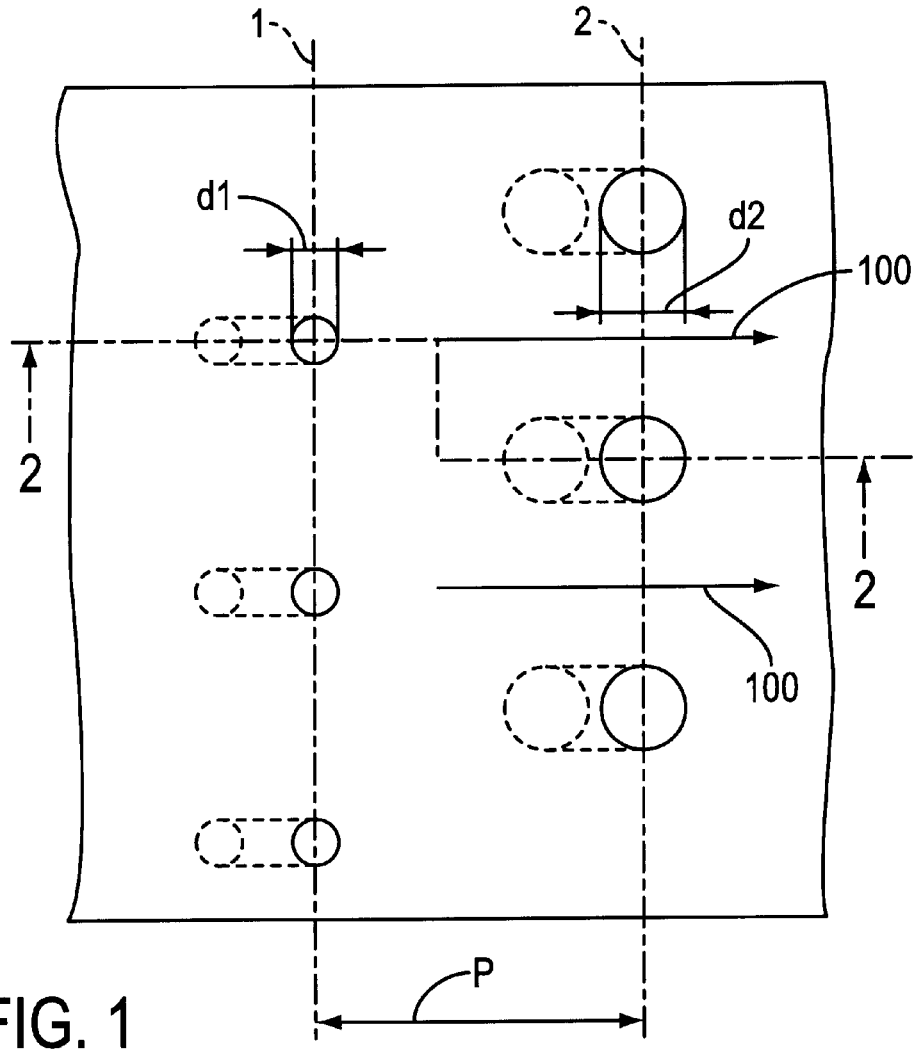
FIG. 1 shows a plan view of a component portion with cylindrical holes.
Figure 2:
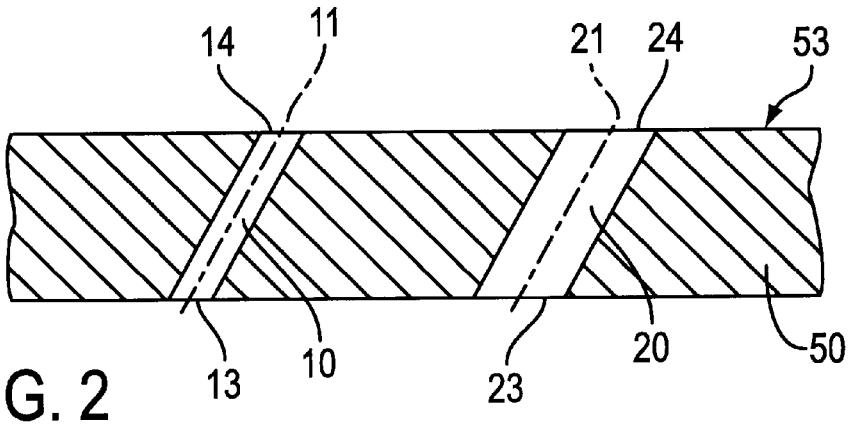
FIG. 2 shows the section along 2—2 of FIG. 1.

Referring now to the drawings, wherein like reference numerals designate identical or corresponding parts throughout the views and only components essential for understanding the invention are shown, the arrangement of holes shown in FIG. 1 and 2 has a first row 1 of holes 10. The holes 10 are arranged equidistant from one another. In the case of a turbine vane or blade, the holes 10 can extend over the complete height of the vane or blade.

A second row 2 of holes 20 is provided adjacent to and downstream of row 1.

In the embodiment example shown, the holes 10, 20 have a rotationally symmetrical configuration with respect to the axes of rotation 11, 21 and are therefore basically cylindrical in shape. The holes 10, 20 completely penetrate a wall 50 in the axial direction while forming inlet openings 13, 23 and outlet openings 14, 24.

The number of holes 10 of the first row 1 is substantially equal to the number of holes 20 of the second row 2. The expression "substantially equal to" in this connection means that because of the staggered arrangement of the holes 10 relative to the holes 20 shown here, one of the two rows 1, 2 can have an additional hole for reasons of symmetry but otherwise there is an association between the holes 10 of the first row 1 and the holes 20 of the second row 2. In the embodiment example shown in FIG. 1, the association is such that the outlet openings 24 of the holes 20 are arranged, relative to the direction of the hot gas flow 100, in the center between the outlet openings 14 of the holes 10. This type of stagger has been found to be particularly favorable in terms of the effectiveness of the cooling film being formed.

The diameter d1 of the holes 10 is smaller than the diameter d2 of the holes 20. In the specific case represented here, the diameter d1 is half as large as the diameter d2 in each case. This relationship ensures that the partial cooling film emerging through the holes 10 lies completely above the further partial cooling film emerging through the holes 20 and that the latter is pressed against the wall 50 in the region of the surface 53. On the other hand, the air consumption is extremely small in relation to the cooling effect achieved because of the comparatively small diameter d1.

In this connection, the selection of the distance p between the two rows 1, 2 is also of particular importance. It is correlated with the diameters d1, d2 of the holes 10, 20 and should not exceed five times the arithmetic average of the diameters d1, d2. Otherwise, there is danger of an inadequate interaction between the partial cooling films emerging from the holes 10 and 20.

In the embodiment example shown, the axes of rotation 11, 21 are directed so that the axes are parallel and extend somewhat inclined in the direction of the hot gas flow 100. In consequence, the emerging partial cooling airflows are ejected somewhat in the direction toward the surface 53 to be cooled and are completely deflected because of the additional effect of the hot gas flow 100.

Figure 3:
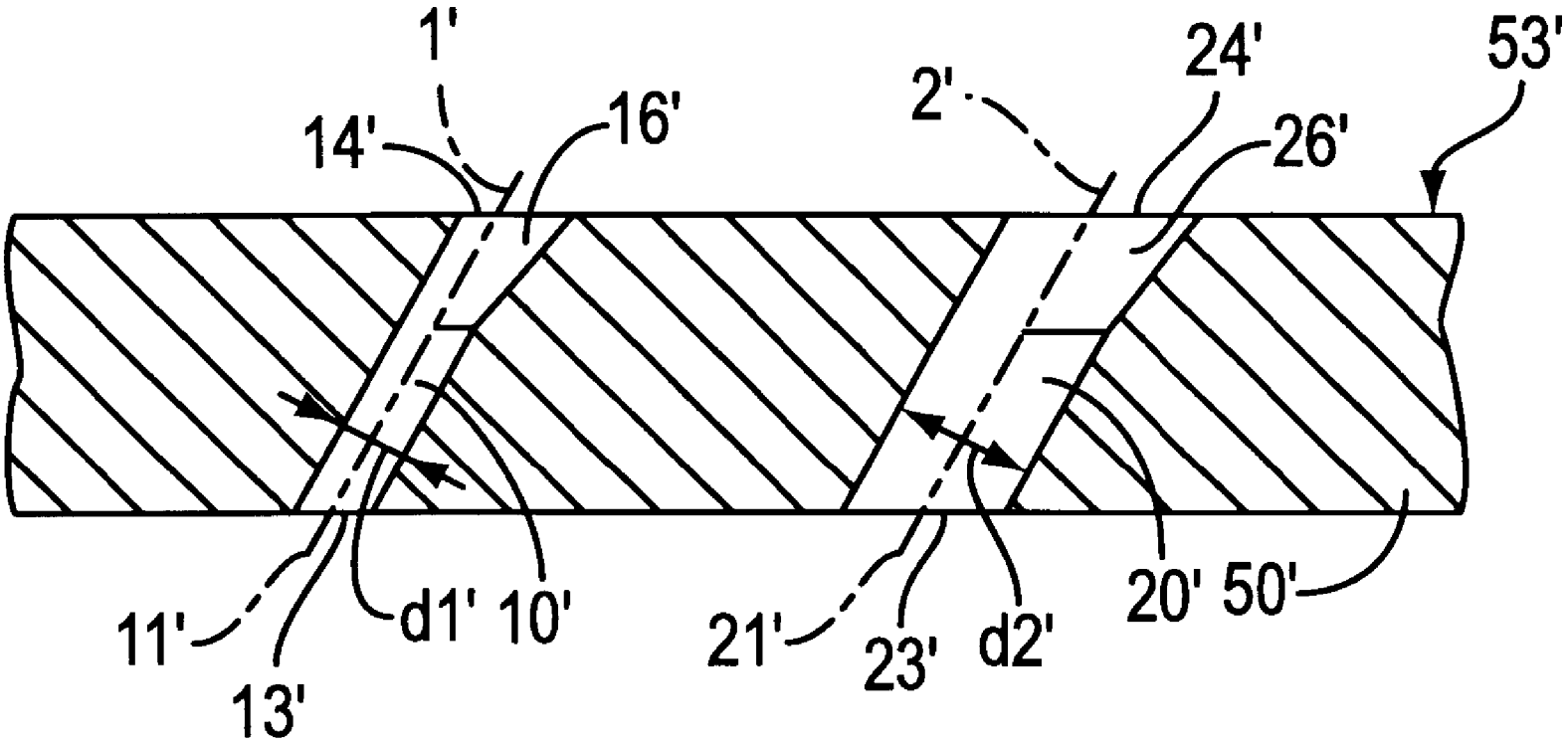
FIG. 3 shows a sectional representation, which is analogous to FIG. 2, of an embodiment variant with funnel-shaped holes.

The embodiment variant shown in FIG. 3 agrees substantially with what has been described above.

Two rows 1', 2' of holes 10', 20', which completely penetrate a wall 50', are again provided. The diameters d1' of the holes 10' are half as large as the diameters d2' of the holes 20'.

As a departure from the embodiment example described at the beginning, both the holes 10' and the holes 20' have axial portions 16', 26' which expand in funnel shape to outlet openings 14', 24'. The area of the outlet opening 14' is smaller than the area of the outlet openings 24'. In the embodiment example shown, the funnel-shaped axial portions 16', 26' are not rotationally symmetrical about the axes of rotation 11', 21' of the holes 10', 20' but extend more strongly inclined toward the surface 53'. In addition to the reduction in the ejection velocity of the partial cooling airflows due to the funnel shape, there is an additional deflection in the direction toward the surface 53'.

In the extreme case, it is also conceivable to design the holes 10', 20' funnel-shaped over the whole of their axial extent, in which case the condition still has to be satisfied that the diameter of the inlet opening 13' must be smaller than the diameter of the inlet opening 23'.

The embodiment variants shown in FIG. 4 to 7 have cylindrical holes 10 of the first row 1 which agree with those described with respect to FIG. 1 and 2. The special feature lies in the shaping of the holes 20' of the second row 2', which have a funnel-shaped design.

Figure 4:
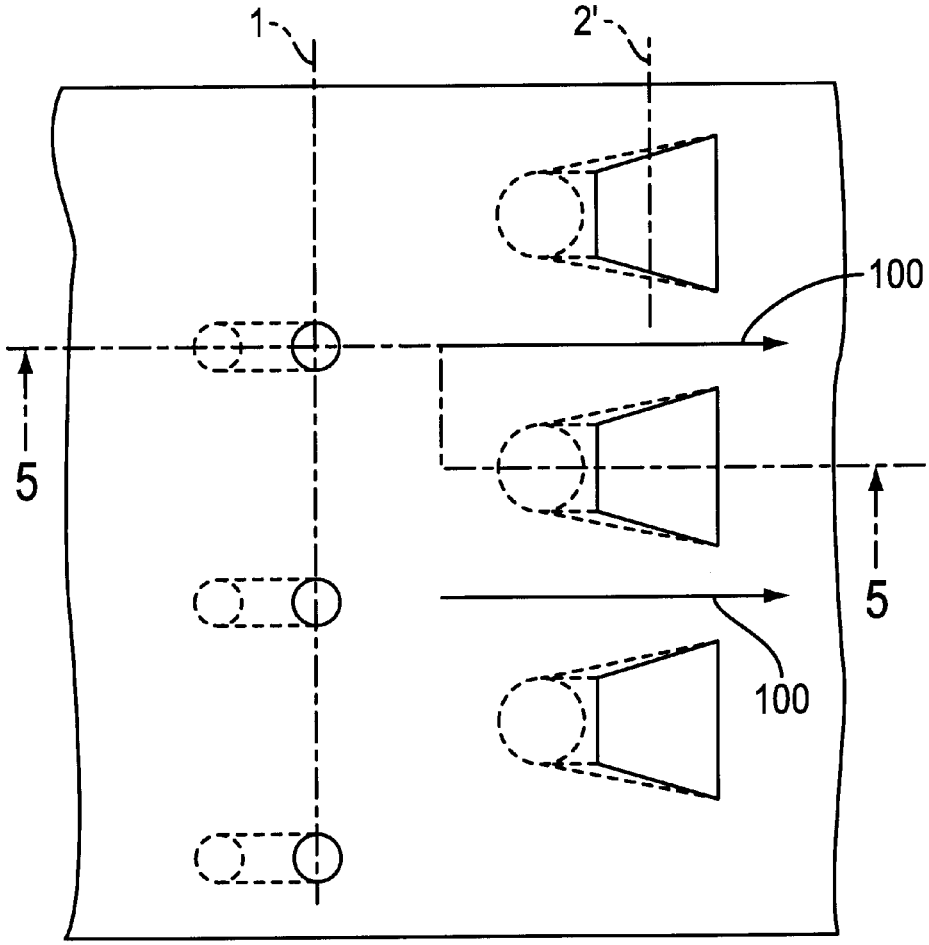
FIG. 4 to FIG. 12 show further embodiment variants with specially designed funnel-shaped holes, in plan view and in sectional representation in each case.
Figure 5:
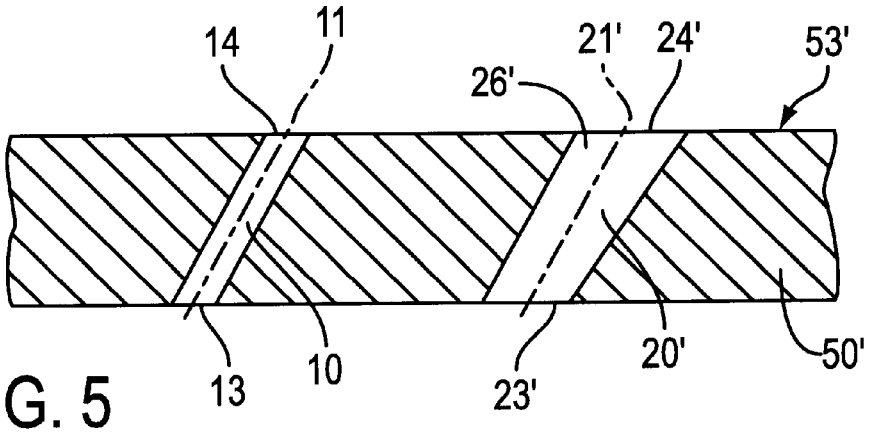

The embodiment shown in FIG. 4 and 5 has holes 20' which have a funnel-shaped configuration over the whole of their axial extent. Corresponding to the variants previously described, the inlet openings 23' are circular, or elliptical in the case of the alignment shown which is inclined forward in the direction of the main flow 100. In the view shown in FIG. 4, the outlet openings 24' have a trapezoidal shape with a width which increases in the direction of the hot gas flow 100. The transition from the circular or elliptical shape of the inlet opening 23' to the trapezoidal shape of the outlet opening 24' takes place continuously over the whole of the axial extent of the hole 20'. In this way, there is an optimally aerodynamically shaped diffuser-type variation of cross-section.

Figure 6:
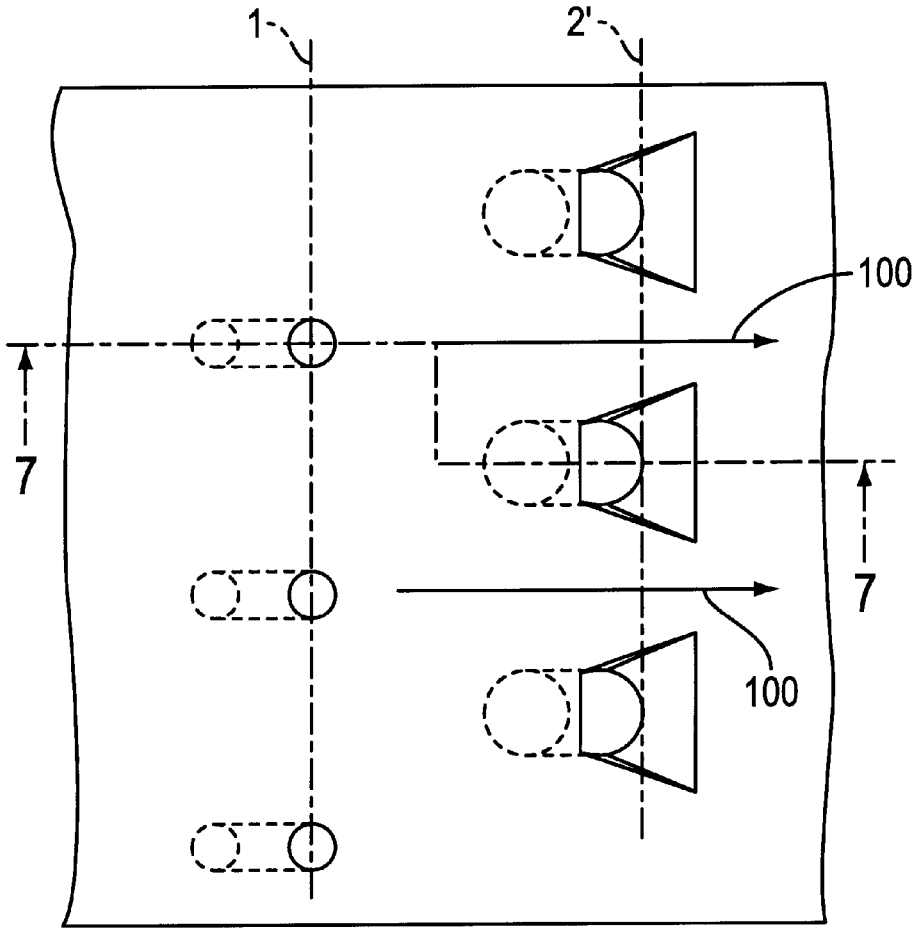
Figure 7:
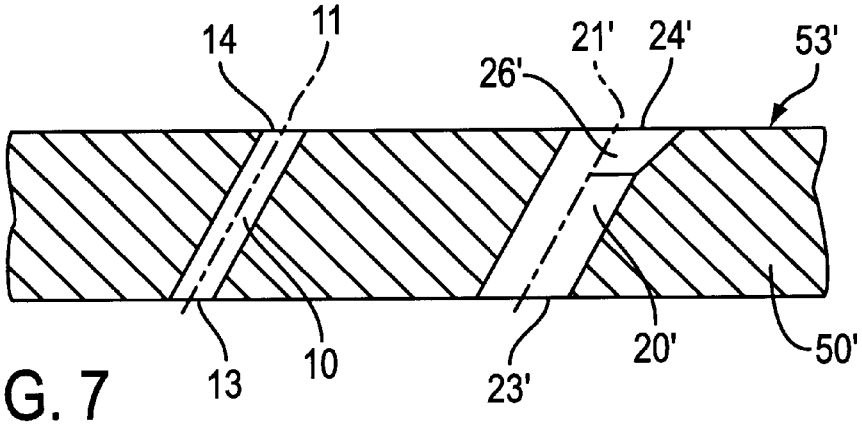

The variant shown in FIGS. 6 and 7 differs from the preceding variant in the variation of cross-section of the hole 20' in the axial direction. Starting from the inlet opening 23', the hole is initially of cylindrical shape. It is only in the vicinity of the outlet opening 24' that the funnel-shaped axial portion 26' is added and this completes the transition from the circular or elliptical shape to the trapezoidal shape.

The embodiment examples represented in FIG. 8 to 11 show variations of holes 10' of the first row 1'. The holes 20' of the second row 2' agree with those of the previously described variant as shown in FIGS. 6 and 7.

Figure 8:
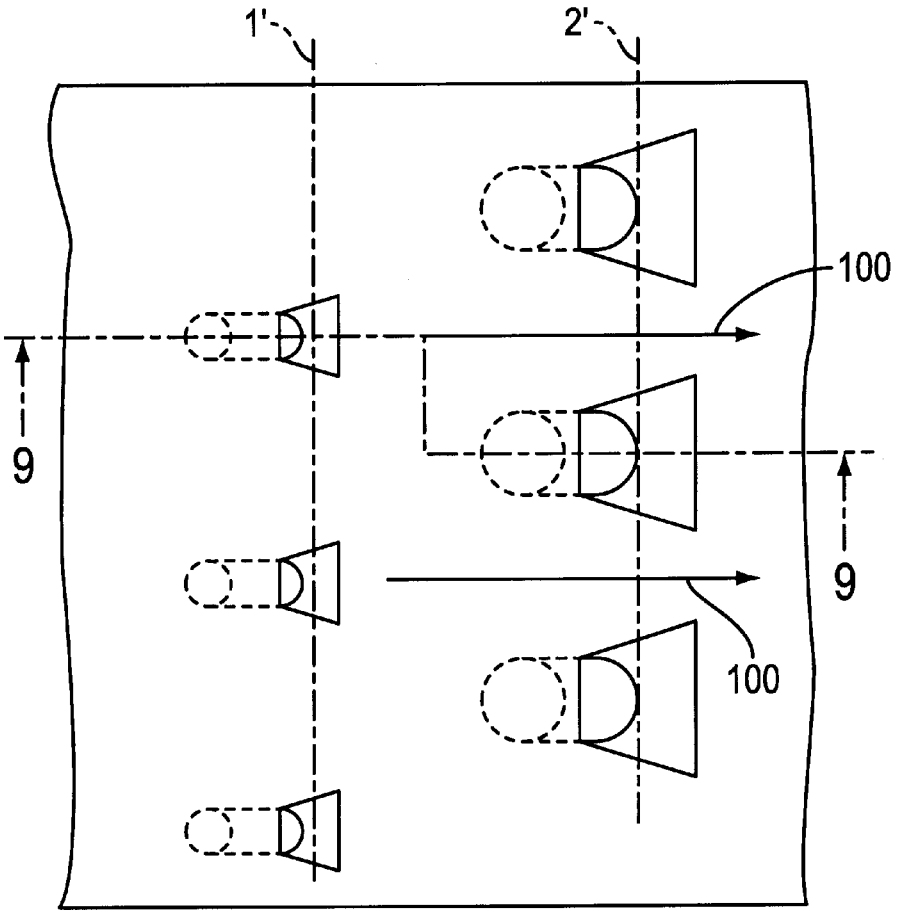
Figure 9:
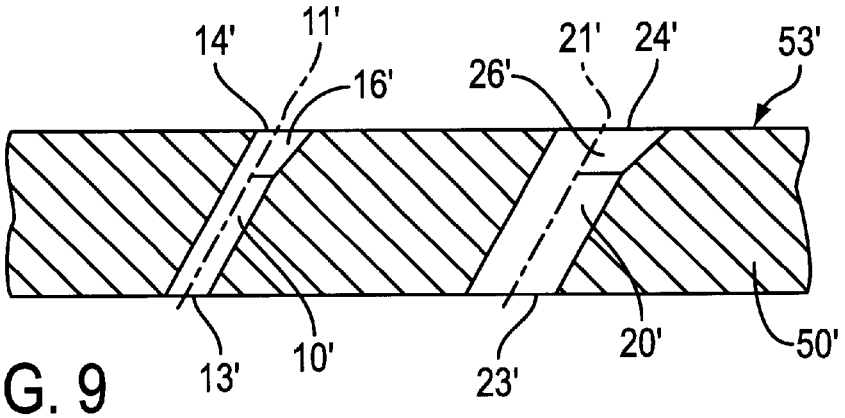

FIGS. 8 and 9 show a modification in which the outlet opening 14' is likewise of trapezoidal shape, the funnel-shaped axial portion 16' being limited to a region adjacent to the outlet opening 14'.

Figure 10:
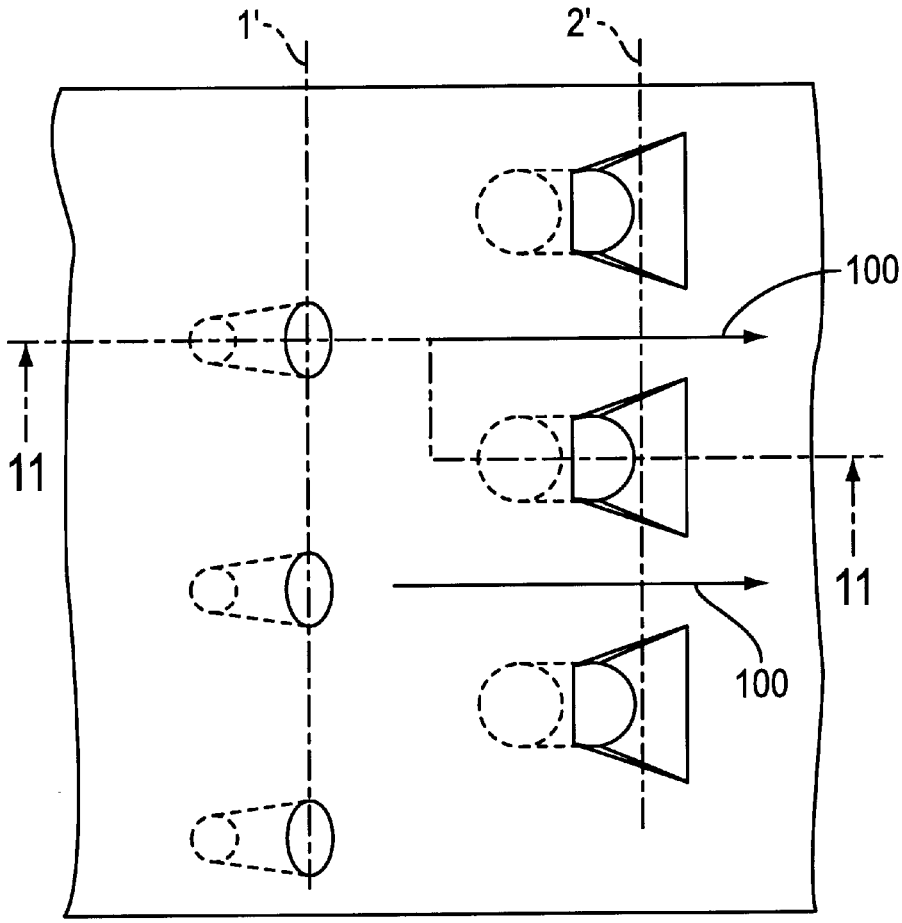
Figure 11:
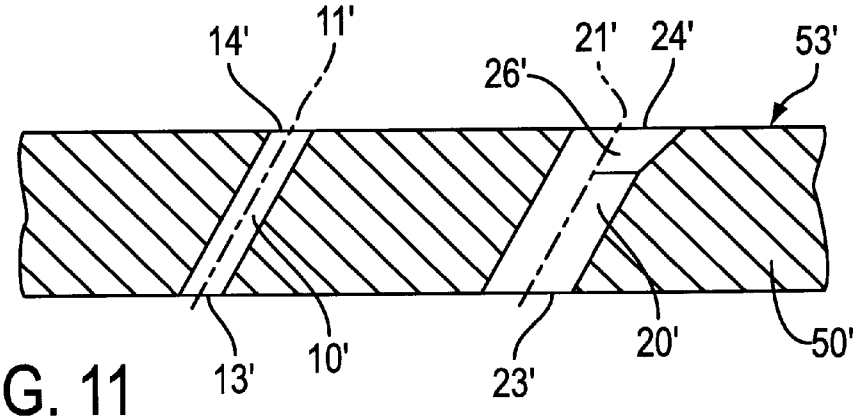
Figure 12:
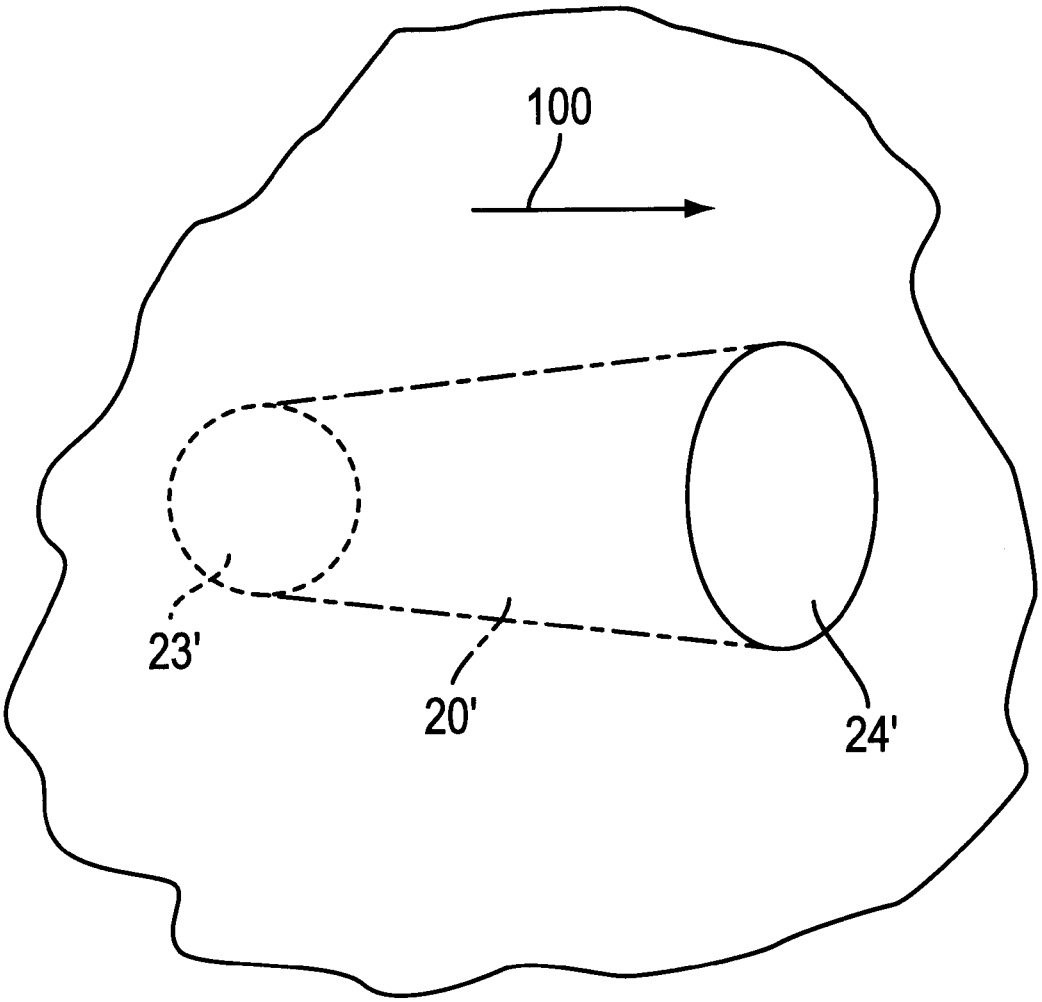

The embodiment examples shown in FIGS. 10–12 have holes 10' and/or 20 whose outlet openings are widened transverse to the direction of the hot gas flow 100. The transition from the circular or elliptical shape of the inlet openings 13' and/or 23' to the elongated hole shape of the outlet openings 14' and/or 24' takes place continuously along the axial extent of the holes 10' and/or 20'. A transition along a shorter axial portion in the region of the outlet opening 14' is also, however, likewise possible.

The embodiment examples shown in FIGS. 4 to 11 have the common feature that even in the case of holes which are not manufactured in such a high precision manner and are, for example, manufactured by means of a laser beam, a cooling film is formed which is highly efficient and stable over large distances. In consequence, the areas of the outlet openings 14' of the holes 10' can be selected to be very much smaller than the areas of the outlet openings 24' of the holes 20'.

In a specific test set-up, it was possible to demonstrate the efficiency of the film cooling using a turbine profile. The diameter d1 was 0.35 mm and the diameter d2 was 0.50 mm.

The hole arrangement was located on the suction surface of the turbine profile at S/L=0.37 (where S is the particular distance along the profile and L is the total distance to the trailing edge). It could be demonstrated that the cooling film which formed was effective not only in the immediate vicinity of the arrangement of holes but also in the vicinity of the trailing edge and exhibited substantially better cooling effectiveness when compared with a comparative test using a conventional double-row arrangement with holes of the same diameters.

Numerous modifications and variations of the present invention are possible in light of the above teachings. It is therefore to be understood that within the scope of the appended claims, the invention may be practiced otherwise than as specifically described herein.

LIST OF DESIGNATIONS

| | |
|---|---|
| 1 | Row |
| 1' | Row |
| 2 | Row |
| 2' | Row |
| 10 | Hole |
| 10' | Hole |
| 11 | Axis of rotation |
| 13 | Inlet opening |
| 13' | Inlet opening |
| 14 | Outlet opening |
| 14' | Outlet opening |
| 16' | Funnel-shaped axial portion |
| 20 | Hole |
| 2' | Hole |
| 21 | Axis of rotation |
| 23 | Inlet opening |
| 23' | Inlet opening |
| 24 | Outlet opening |
| 24' | Outlet opening |
| 26' | Funnel-shaped axial portion |
| 50 | Wall |
| 50' | Wall |
| 53 | Surface |

-continued

LIST OF DESIGNATIONS

| | |
|---|---|
| 53' | Surface |
| 100 | Hot gas flow |
| d1 | Diameter of the holes in the first row |
| d1' | Diameter of the holes in the first row |
| d2 | Diameter of the holes in the second row |
| d2' | Diameter of the holes in the second row |
| p | Distance between the two rows |

What is claimed as new and desired to be secured by Letters Patent of the United States is:

1. An arrangement of holes for forming a cooling film on a component wall subjected to a flow of hot gas, the component being selected from the group consisting of a turbine vane, a turbine blade, and a combustion chamber of a gas turbine, the arrangement comprising:

a first row of holes and a second row of holes located adjacent to and downstream of the first row of holes, the diameter of the holes in the first row being smaller than the diameter of the holes in the second row, wherein the number of holes of the first row is substantially equal to or smaller than the number of holes of the second row.

2. The arrangement of holes as claimed in claim 1, wherein outlet openings of the holes of the second row are arranged, relative to the direction of the flow of hot gas, offset to the side of or centrally between outlet openings of the holes of the first row.

3. The arrangement of holes as claimed in claim 1, wherein the holes of the second row are aligned with their axes parallel to the axes of the holes of the first row.

4. The arrangement of holes as claimed in claim 1, wherein the diameter of the holes of the first row is greater than or equal to half the diameter of the holes of the second row.

5. The arrangement of holes as claimed in claim 1, wherein the distance between the first row and the second row is less than or equal to five times the arithmetic average of the diameters of the holes of the first row and the second row.

6. The arrangement of holes as claimed in claim 1, wherein the holes of the second row have an axial portion with a funnel-shaped variation of the cross-section in the region of the outlet openings.

7. The arrangement of holes as claimed in claim 6, wherein the holes of the first row have an axial portion with a funnel-shaped variation of the cross-section in the region of the outlet opening, the area of each of the outlet openings of the first row being smaller than the area of each of the outlet openings in the second row.

8. The arrangement of holes as claimed in claim 6, wherein the funnel-shaped axial portions are formed by means of laser.

9. The arrangement of holes as claimed in claim 6, wherein a set of outlet openings selected from the group consisting of the first row hole outlet openings, the second row hole outlet openings, and both, are configured to be trapezoidal in plan view with the width increasing in the direction of the flow of hot gas.

10. The arrangement of holes as claimed in claim 6, wherein a set of outlet openings selected from the group consisting of the first row hole outlet openings, the second row hole outlet openings, and both, have the shape of elongated holes in plan view, which elongated holes are aligned transverse to the direction of the flow of hot gas.

* * * * *